United States Patent [19]

Baskevitch et al.

[11] Patent Number: 4,895,175

[45] Date of Patent: Jan. 23, 1990

[54] METHOD FOR THE PREPARATION OF AROMATIZED RECONSTITUTED TOBACCO

[75] Inventors: Nicolas Baskevitch; Gilbert Ferrer, both of Parigne l'Eveque; Laurent Wagner, Grasse, all of France

[73] Assignee: LTR Industries, paris, France

[21] Appl. No.: 34,926

[22] Filed: Apr. 6, 1987

[30] Foreign Application Priority Data

Apr. 7, 1986 [FR] France ..... 86 04938

[51] Int. Cl.[4] ..... A24B 3/14; A24B 15/02

[52] U.S. Cl. ..... 131/297; 131/308

[58] Field of Search ..... 131/373, 308, 374, 297, 131/298

[56] References Cited

U.S. PATENT DOCUMENTS

| | | | |
|---|---|---|---|
| 4,135,521 | 1/1979 | Malan et al. | 131/308 |
| 4,566,468 | 1/1986 | Sachleben et al. | 131/298 |
| 4,622,982 | 11/1986 | Gaisch et al. | 131/308 |

*Primary Examiner*—V. Millin

*Attorney, Agent, or Firm*—Thomas J. Greer, Jr.

[57] ABSTRACT

Aromatized reconstituted tobacco is prepared from tobacco particles by extracting the particles with water to form an extract containing between 5 and 20 g/l of sugar, fermenting the extract with a yeast of the genera kluyveromyces, saccharomyces or candida, forming sheets from the extracted particles, and incorporating the fermented extract into those sheets.

17 Claims, 1 Drawing Sheet

METHOD FOR THE PREPARATION OF AROMATIZED RECONSTITUTED TOBACCO

BACKGROUND OF THE INVENTION

1. Field of the Invention

The present invention relates to a method for the preparation of reconstituted tobacco, aromatized by fermentation, to aromatized reconstituted tobaccos obtained by this method and to mixtures of tobaccos containing them.

During cigarette manufacture, only a part of the tobacco leaf, the lamina, is used. The midbribs (or stems) are removed by beating or stripping. The leaf is then chopped into shreds (orscaferlatis). These treatments give rise to fragments called fines, fragments or "scraps" and stems depending on their size and their origin. They represent up to 20% of the initial mass of tobacco and may be recycled and reintroduced into cigarettes, in the form of reconstituted tobacco.

The reconstitution consists in converting these fragments into a sheet which is later chopped and reincorporated into tobacco mixtures for cigarettes or used as the wrapping for cigars (binders and wrappers).

This sheet may be obtained by grinding, attrition or disaggregation of the fragments and then mixing with a binder and various additives (reinforcing fibers, fungicides, humectants, aromas and various fillers), spreading the paste obtained on an endless metal belt, drying, winding and, where appropriate, dividing the leaf into strips.

Many methods for reconstitution are known, for example, stratification methods, solvent evaporation methods, impregnation methods or extrusion methods. The reconstituted tobacco resulting from the first four methods is generally used for preparing the binders and wrappers for cigars.

For the production of sheets intended for use in tobacco mixtures for cigarettes, a paper-manufacturing method is most frequently used for reconstituting the tobacco, a typical diagram of which is given in FIG. 1. According to such a method, tobacco fragments originating from the beating or the chopping of the leaves are collected together and after sieving, mixed with water, for example in a digester 1, which enables the water-soluble products to be extracted. The soluble products are then separated from the insolubles, for example, by passing the paste obtained through a screw press 2. In such a paper method, the insoluble products are therefore separated from the soluble products so as to treat them separately. The fibers pass, for example, through a refiner 3 before passing through a papermaking machine 4 so as to form a sheet of tobacco fibers or the base sheet.

Soluble products in aqueous solution originating from the pressing, i.e. the strong liquor, are concentrated, for example, in a vacuum evaporating device 5, before being reincorporated into the base sheet so as to form a reconstituted sheet. The reconstituted sheet is then treated in a drying device 6.

Their reconstituted tobacco sheet will then be cut into thin sheets similar to tobacco strips which are reintroduced into tobacco mixtures for cigarettes.

In order to aromatize a tobacco, "sauces" or "tobacco juices" are usually introduced during manufacture.

These sauces may contain humectants such as glycerin or propylene glycol, sugars such as glucose or invert sugar, aromatizing agents such as cocoa, liquorice or fruit extracts, or synthetic aromatizing agents or additives.

In some conventional methods, the aromatization is carried out, for example, by spraying the "sauces" before or after drying the tobacco. In a reconstituted tobacco manufacturing method, these sauces or juices are added into the impregnation liquor. The major disadvantage of these sauces or juices stems from the fact that substances foreign to tobacco, and therefore the taste properties or "notes" which are not identical to those of tobacco, are introduced into the tobacco.

2. Description of the Prior Art

In another known aromatization method described in the publication FR-A-2,354,716 (which corresponds especially to publications GB 1,520,234, Au 2,353,977, U.S. Pat. No. 4,135,521, JP 52,156,999 and CA 1,074,986), an aromatization liquor which was obtained by fermenting a tobacco suspension to which a high proportion of sugar (20 kg of sugar per 10 kg of tobacco) was added and the suspension was filtered after fermentation and the filtered suspension was concentrated, if required, is introduced into the tobacco.

Application of this technique to the aromatization of a reconstituted tobacco sheet would therefore consist in adding to the said strong liquor defined above an aromatizing liquor, which will not be of any type, but would have been prepared in accordance with the teachings of the publication FR-A-2,354,716.

Such an aromatization method does not give satisfactory results either from a technical standpoint or from a profitability standpoint.

SUMMARY OF THE INVENTION

The object of the present invention is also to employ fermentation for improving the aroma of tobacco, but avoiding the disadvantages mentioned above.

This is achieved, according to the invention, by fermenting the strong liquor directly by means of a yeast, without the need for a sugar addition and without the need for adding an aromatizing liquor to the strong liquor.

Therefore, the invention provides a method for the preparation of aromatized reconstituted tobacco starting with tobacco particles, in which these particles are mixed with water to obtain, on the one hand, an aqueous solution (called "strong liquor") containing water-soluble products of the tobacco particles and, on the other hand, insoluble products, the strong liquor is separated from the insoluble products, the strong liquor is concentrated, sheets are prepared from said insoluble products and said concentrated strong liquor is incorporated into the sheets so as to obtain, after drying, reconstituted tobacco sheets, wherein, before concentrating, said strong liquor is seeded with yeast and the yeasts are removed after fermentation.

"Tobacco particles" refers to lamina fragments and/or fragments of stems or midribs and/or tobacco fines produced in the course of the various manipulations and treatments during the conversion of the natural tobacco leaf into the product for smoking.

The strong liquor may be subjected to other treatments, in a manner known per se, in order to remove therefrom the constituents which are regarded as undesirable, but these other treatments to which the present invention does not relate, will not be described.

However, it will be pointed out here, in order to avoid any confusion, that fermentation to remove undesirable constituents from the tobacco is recommended; this is so, for example, in the case of the publication EP-A-0,024,152 (or CA 1,129,357 or U.S. Pat. No. 4,622,982) which recommends the fermentation of the tobacco, under very specific conditions, in order to reduce the content of some nitrogen-containing compounds, but this does not relate either to reconstituted tobacco or to improving the aroma of the tobacco. This is also true in the case of the publication FR-A-2,419,034 (or GB 1,557,253 or U.S. Pat. No. 4,308,877) which recommends a fermentation technique in order to reduce the nitrate content and in the case of the publication EP-A-0,070,112 (or CA 1,191,673) which also recommends de-nitrification using microorganisms.

Thus, it will be pointed out that microorganisms have also been used to reduce the content of other tobacco constituents such as nicotine (FR-A-2,437,794, U.S. Pat. No. 4,140,136, U.S. Pat. No. 151,848).

The method according to the invention makes it possible to aromatize the stems, in particular the parts of leaves which are normally without aroma as compared with the leaf lamina and therefore to valorize these parts, and this is achieved without introducing foreign notes into the notes of the tobacco itself.

The yeast with which the strong liquor is seeded serves, on the one hand, for competing with the undesirable contaminating natural flora and, on the other hand, for using up the assimilable substrates, mainly reducing sugars, contained in the strong liquor so as to produce aromatizing components.

DESCRIPTION OF THE PREFERRED EMBODIMENTS

Figure 1:
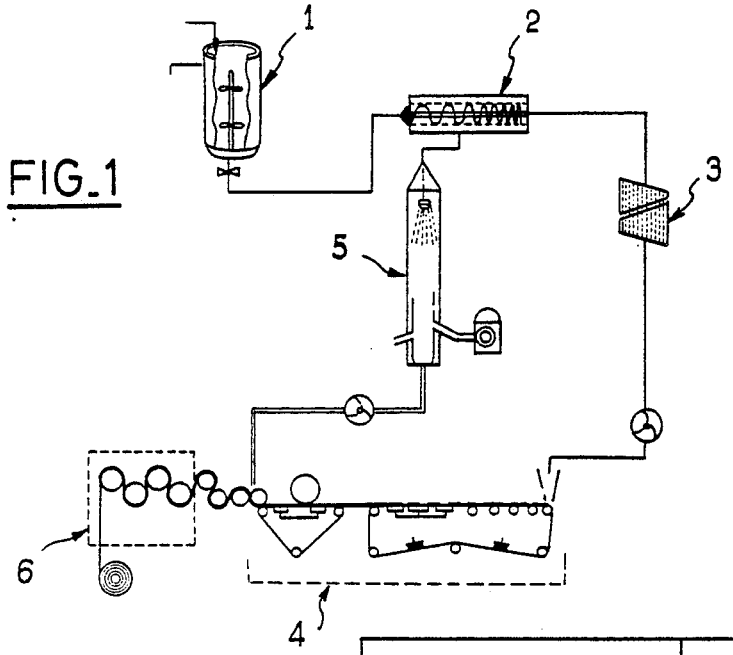
FIG. 1 shows a diagram for the conventional paper-manufacturing method for tobacco reconstitution described above.

The yeasts employed originate preferably from strains chosen from amongst the genera Candida, Kluyveromyces or Saccharomyces, for example, from amongst *Candida pseudotropicalis, Candida utilis, Kluyveromyces fragilis, Saccharomyces diastaticus, Saccharomyces cerevisiae,* preferably *Kluyveromyces fragilis* and *Saccharomyces cerevisiae,* chosen for their good aromatization of the strong liquor without supplying nutrients, and for their heat resistance which is essential during the process.

These yeasts may originate from cultures of strains in a synthetic medium or from the recycling of yeasts produced at the end of a preceding fermentation.

Before being seeded, the strong liquor must preferably have a refractometric value of between 1% and 15%, preferably between 4% and 12%, each initial sugar concentration must be preferably between 5 and 20 g/l.

For the purpose of its aromatization, the strong liquor may, in general, be fermented without adding any external component, although the latter may be useful under certain particular conditions.

This strong liquor is seeded with the yeast so that the seeded liquor has an initial yeast concentration of between 0.25 and 60 g/l, preferably between 1 and 50 g/l.

The fermentation conditions obviously depend to a large extent on the yeast employed and the properties of the strong liquor. The fermentation is aerobic.

The fermentation may be carried out in fermenters of known type for fermentation by yeasts, i.e. in fermenters equipped with a stirring and aerating device, and with temperature control.

The fermentation temperature depends on the yeast employed and is generally between 20° and 50° C. and preferably between 30° and 45° C.

The stirring of the medium is carried out by any means, for example a pumping system which circulates the liquor through an external loop at a rate, for example, of from 10 to 20 $m^3/h$, or by a conventional stirring system such as a motor-driven propeller (125–175 rpm). This stirring also enables a better diffusion of the oxygen injected to be achieved. The injection of oxygen is carried out, for example, by injecting air through a perforated ring located at the bottom of the fermenter, at a rate of between 0.1 and 0.5 v/v/m (1 volume of oxygen/volume of liquor/minute), preferably 0.3 v/v/m.

The fermentation generally lasts from 1 h to 6 h, preferably from 2 to 3 h.

When the fermentation is complete, the fermentation product is purified. For this purpose, the fermented strong liquor is separated from the yeasts, for example, by centrifugation, which stops the fermentation. In a particular embodiment, the efficiency of separation of yeasts and of the liquor is enhanced by treating, after centrifugation, in a self-cleansing clarifier.

The purified strong liquor is then concentrated with a view to impregnating the base sheet.

The separated yeasts may be recycled as inoculum for subsequent fermentations or may be valorized, for example, in the form of animal feed.

Tobaccos which can be treated by such a paper reconstituting method are, in particular, all tobaccos of the "virginia" type and "bright" tobaccos originating from Brazil, China, Malawi, South Korea, Thailand, Philippines, Canada, India, Italy, Japan, USA, Zimbabwe and Zambia.

A reconstituted tobacco with characteristic and original organoleptic qualities is thus obtained by this strong liquor-aromatizing treatment.

The present invention also relates to aromatized reconstituted tobacco obtained by the method and to mixtures of this reconstituted tobacco with tobaccos from different sources.

The reconstituted tobacco thus obtained formed the subject of tasting tests by a group of specialists. By virtue of these tests, an improvement in certain "virginia" notes, a better "roundness" and a better "balance" could be observed in the case of cigarettes made exclusively from aromatized reconstituted tobacco.

Trials involving the introduction of this aromatized reconstituted tobacco to the extent of 30% into a virginia mixture available on the market has made it possible to ascertain the presence of these notes, a definite improvement in the taste qualities compared with cigarettes which comprise untreated reconstituted tobacco and a deterioration in the usual organoleptic properties of an untreated reconstituted tobacco.

Figure 2:
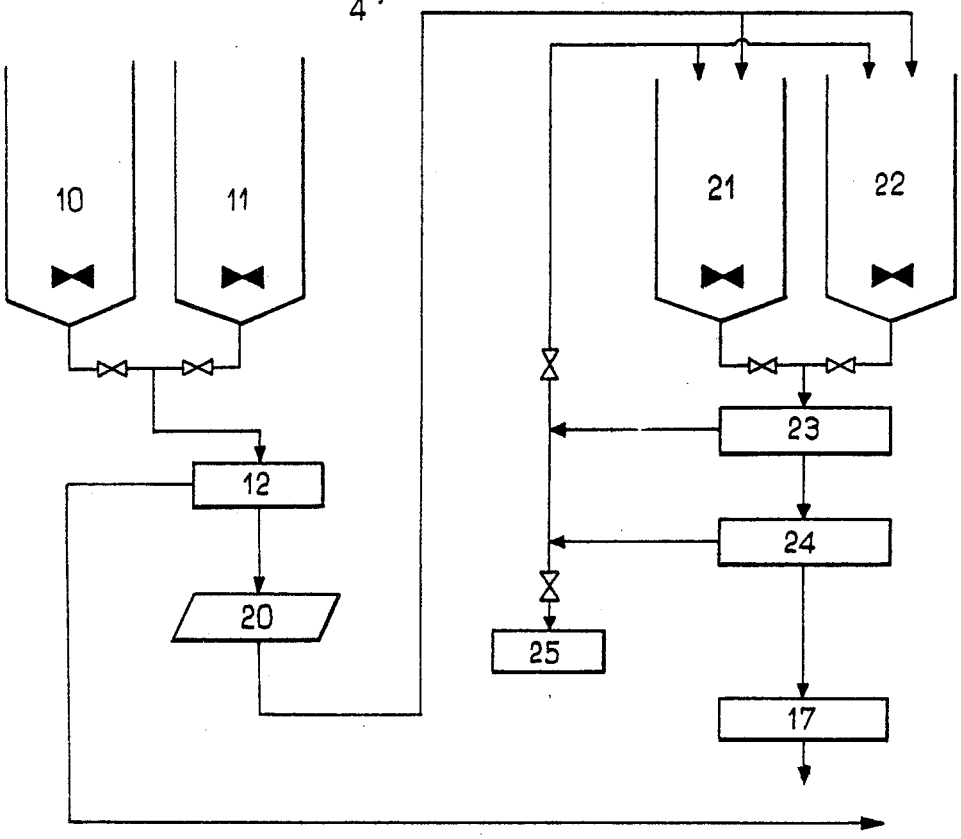
FIG. 2 shows a diagrammatic representation of one embodiment of the method of the present invention.

As illustrated in FIG. 2, after a period of residence of the tobacco fragments in aqueous solution in one of the digesters 10 or 11, the fibers are separated from the strong liquor, which undergoes aromatization, by being passed through a press 12. On exit from the press 12, the fibers are treated according to the conventional method so as to form a base sheet. The strong liquor passes through a bar screen 20 before being treated in one of the fermenters 21 or 22 which comprise a stirring device and an air injection device.

After fermentation, in order to separate the yeast, the strong liquor passes through a centrifuge 23, and then into a self-cleansing clarifier 24, before being concentrated in an evaporating device 17. The yeast is recovered on exit from the centrifuge and/or clarifier in a storage tank 25 with a view to re-using it in another fermentation or valorizing it.

On exit from the concentrating device 17, the aromatized strong liquor is reimpregnated into the base sheet in the paper-making machine.

EXAMPLE 1

Fermentation of the strong liquor on an industrial scale

This fermentation was carried out under the following conditions:

The extraction was carried out using 500 kg of tobacco, 350 kg of which were virginia scraps and 150 kg of which were virginia stems. 3600 liters of strong liquor with a refractometric value of 5% and containing 13.6 g/l of reducing sugars were obtained.

The yeast employed originated from a *Saccharomyces cerevisiae* strain, chosen as described above; it is cultured in a synthetic culture medium with the following composition:

| | |
|---|---|
| glucose monohydrate | 22 g |
| $NH_4Cl$ | 5 g |
| $KH_2PO_4$ | 12 g |
| $Na_2HPO_4$ | 0.4 g |
| Mg $SO_4$, 7 $H_2O$ | 2 g |
| NaCl | 1 g |
| yeast extract | 10 g |
| $FeSO_4$, $7H_2O$ | 20 mg |
| $MnSO_4$, $H_2O$ | 5 mg |
| $CoCl_2$ | 2 mg |
| Zn $SO_4$, $6H_2O$ | 1 mg |
| $Na_2$ $MoO_2$, $2H_2O$ | 1 mg |
| $CuCl_2$ | 0,5 mg |
| $H_3$ $BO_3$ | 0,25 mg |
| $H_2O$ q.s.p. | 1 l |

The reactor used is a 5000-l tank equipped with a device for circulating cold or hot water for controlling the temperature. Air injection is carried out through a ring pierced with several holes located at the bottom of the tank. Stirring is ensured by a pump which circulates the liquor through an external loop at a rate of 14 $m^3$/h.

The temperature is adjusted at 36° C.

The rate of aeration obtained is 0.3 v/v/m.

The 3600 liters of strong liquor are inoculated with 8.7 kg of yeasts, which amounts to an initial concentration of 2.42 g/l.

Fermentation was stopped after 2 h, which included 20 min of centrifugation. The refractometric value of the liquor was then 4% and the residual sugar concentration was 6.5 g/l.

52.6% of the sugars were consumed during this fermentation.

Result of the tasting

For the cigarettes corresponding to this product, the taste panel could demonstrate an improvement in the "virginia" notes such as "floral", "smoked wood" and "hay". Additionally, the product had a better "roundness" and a better "balance".

EXAMPLE 2

Fermentation of the strong liquor on an industrial scale

This fermentation was carried out under the following conditions:

The extraction was carried out using 500 kg of tobacco consisting of:

150 kg of virginia stems
250 kg of virginia (Canada) scraps, and
100 kg of virginia (Zimbabwe) scraps.

4800 liters of strong liquor with a refractometric value of 4% and containing 12.1 g/l of reducing sugars were obtained.

The yeast employed is *Saccharomyces cerevisiae,* recycled from a previous fermentation.

The reactor used is practically the same as in Example 1. The liquor was seeded with 7.87 kg of yeast on a dry-weight basis, which amounts to an initial concentration of 1.64 g/l.

Stirring is ensured by a motor-driven propeller rotating at 150 rpm.

The temperature is adjusted to 37° C.

The rate of aeration is maintained at 0.3 v/v/m, air injection is carried out in the same way as in Example 1, but oxygen transfer is improved by the provision of baffles on the tank generators.

Purification is carried out by centrifugation, and the centrifuged strong liquor is then treated in a self-cleansing clarifier (Westphalia®).

Culturing is stopped by starting the centrifugation at the most appropriate time, i.e. after 2 h 40 min of culturing; purification ends 40 minutes later. 73.5% of reducing sugars are consumed at this stage.

Result of the tasting

The presence of "virginia" notes and a deterioration in the properties of a reconstituted tobacco were confirmed in the case of cigarettes manufactured from the treated reconstituted tobacco.

The trials involving introducing up to 30% into a virginia mixture available on the market enabled results comparable to those of the previous example to be obtained.

We claim:

1. A method for the preparation of aromatized reconstituted tobacco from tobacco particles which comprises:

(a) extracting tobacco particles with water;
(b) separating the water extract from the extracted tobacco particles;
(c) innoculating the water extract with a yeast selected from the genera kluyveromyces and saccharomyces, and fermenting the water extract with the yeast;
(d) removing the yeast from the fermented water extract;
(e) concentrating the fermented water extract;
(f) preparing sheets of reconstituted tobacco from the water extracted tobacco particles;
(g) incorporating the concentrated fermented water extract into the sheets of reconstituted tobacco; and
(h) drying the sheets of reconstituted tobacco having the concentrated fermented water extract incorporated therein.

2. The method according to claim 1 wherein the water extract has an initial refractometric value of between 1 and 15%.

3. The method according to claim 2 wherein the initial refractometric values is between 4 and 12%.

4. The method according to claim 1 wherein the water extract is innoculated with yeast at a concentration between 0.25 and 60 g/l of the water extract.

5. The method according to claim 4 wherein the concentration of the yeast is between 1 and 50 g/l of the water extract.

6. The method according to claim 1 wherein the yeast is saccharomyces cerevisiae.

7. The method according to claim 1 wherein fermentation is aerobic.

8. The method according to claim 1 wherein the yeast is removed by centrifugation.

9. A method for the preparation of aromatized reconstituted tobacco from tobacco particles which comprises:

(a) extracting tobacco particles with water to form a water extract containing between 5 and 20 g/l of sugar;

(b) separating the water extract from the extracted tobacco particles;

(c) innoculating the water extract with yeast and fermenting the water extract with the yeast;

(d) removing the yeast from the fermented water extract;

(e) concentrating the fermented water extract;

(f) preparing sheets of reconstituted tobacco from the water extracted tobacco particles;

(g) incorporating the concentrated fermented water extract into the sheets of reconstituted tobacco; and (h) drying the sheets of reconstituted tobacco having the concentrated fermented water extract incorporated therein.

10. The method according to claim 9 wherein the tobacco particles are of the Virginia type.

11. The method according to claim 9 wherein the tobacco particles are of the bright tobacco type.

12. The method according to claim 9 wherein the water extract is innoculated with yeast at a concentration between 0.25 and 60 g/l of the water extract.

13. The method according to claim 12 wherein the concentration of the yeast is between 1 and 50 g/l of the water extract.

14. The method according to claim 9 wherein the yeast is selected from the genera kluyveromyces, saccharomyces and candida.

15. The method according to claim 14 wherein the yeast is saccharomyces cerevisiae.

16. The method according to claim 9 wherein fermentation is aerobic.

17. The method according to claim 9 wherein the yeast is removed by centrifugation.

* * * * *